US005096631A

United States Patent [19]

Syversen

[11] Patent Number: 5,096,631

[45] Date of Patent: Mar. 17, 1992

[54] METHOD AND DEVICE FOR PROVIDING A COLLAR ABOUT AN ANODE NIPPLE

[75] Inventor: Dag Syversen, Tistedal, Norway

[73] Assignee: Robotec Engineering A/S, Halden, Norway

[21] Appl. No.: 585,056

[22] PCT Filed: Apr. 28, 1989

[86] PCT No.: PCT/NO89/00041

§ 371 Date: Oct. 17, 1990

§ 102(e) Date: Oct. 17, 1990

[87] PCT Pub. No.: WO89/10436

PCT Pub. Date: Nov. 2, 1989

[30] Foreign Application Priority Data

Apr. 29, 1988 [NO] Norway ..... 881903
Dec. 28, 1988 [NO] Norway ..... 885787

[51] Int. Cl.[5] ..... H05B 6/02; B29C 69/00; B28B 3/10; C25B 3/12

[52] U.S. Cl. ..... 264/25; 264/71; 264/275; 264/277; 264/104; 425/116; 425/127; 204/279; 204/294

[58] Field of Search ..... 264/26, 71, 275, 277, 264/25, 104, 105; 425/116, 127; 204/286, 294, 279

[56] References Cited

U.S. PATENT DOCUMENTS 3,397,429 8/1968 Zavitz et al. ..... 264/71 X
4,017,569 4/1977 Hass ..... 264/71 X
4,119,692 10/1978 Durinck ..... 264/71
4,687,566 8/1987 Förster et al. ..... 204/243 R
4,756,681 7/1988 Unger et al. ..... 425/125 X
4,787,965 11/1988 Audras et al. ..... 204/294 X

FOREIGN PATENT DOCUMENTS 0092704 11/1983 European Pat. Off. .
0121954 10/1984 European Pat. Off. .
0197887 10/1986 European Pat. Off. .
2547061 6/1978 Fed. Rep. of Germany .
8202406 7/1982 World Int. Prop. O. .

OTHER PUBLICATIONS

Patent Abstract of Japan, vol. 8, No. 67 (C-216 Abstract of JP 58-217686, Publ. 1983-12-17.

*Primary Examiner*—Donald R. Valentine
*Attorney, Agent, or Firm*—Ladas & Parry

[57] ABSTRACT

A method and a device for providing a collar about an anode nipple (4). Collar composition is supplied to a compression mould (6' 6") comprising two sections and is compressed by said compression mould, if desired, with supplied heat and/or vibration, whereupon both sections are released from each other and removed. Alternatively, collar composition may be supplied to two casting mould halves (6) with each of them corresponding to a collar half (33', 33"), and be preformed in them. Collar composition halves (33'33") are then transferred to a compression mould (26) consisting of two sections (26',26") and are, by the aid of the latter, provided about nipple (4) and joined, whereupon the composition is compressed, if desired, treated with heat and/or vibration to cause the composition in compression mould sections to be joined and shaped into one piece of desired collar shape, whereafter the compression mould sections are separated.

29 Claims, 11 Drawing Sheets

METHOD AND DEVICE FOR PROVIDING A COLLAR ABOUT AN ANODE NIPPLE

The present invention relates to methods for providing a collar about an anode nipple, and the device for carrying out said method. The invention especially finds application in protecting anodes for use in aluminium industry.

Most aluminium works at present utilize a technology based on pre-baked anodes, the Söderberg-process being abandoned in production.

Novel technology involves use of anodes that are completed in advance for use, as opposed to the Söderberg-process according to which the anode is continuously moulded into the bath. The anode block proper is moulded onto a hanger means serving both as a suspension means in the furnace, and as a current-carrying element. The hanger means is moulded onto the block by use of cast steel. As the anode is burned off and lowered into the bath, cast steel and nipples on the hanger means will get so close to the bath that problems will arise because steel is corroded off. Primarily, the hanger means will be damaged to such a degree that frequent repair will be necessary and, secondarily, pollution of the bath will result.

However, methods were developed to protect against such damage, as mentioned below.

Present technology involves mounting a collar mould made of aluminium or cardboard about each nipple. Generally, the diameter of such a mould be twice the nipple diameter, whereas its height may vary according to separate specifications at each work, based on experience over a long time.

The collar mould is filled with granulated carbon with an addition of pitch. The collar mould will, thus, serve as a casing for the introduced composition. Mounting and filling the collar mould with composition, occurs at a point of time when anode and nipple are still hot after the hanger was moulded onto the block. Due to the heat, the consistency of the composition will change after a certain time, at least in the region closest to the nipple, so that relative strong protection against burning off is achieved.

Robotec Engineering A/S at present market an automatic machine for fully automatic mounting of collar sheets made of aluminium, as well as collar moulds of cardboard, which previously represented the latest development of the art. This known machine has a rationalization effect as well as taking over a working place having heavy environmental burdens.

As new methods were developed for purification of hanger means after the anode has burned down, e.g. as disclosed in NO-PS No. 155 893, the aluminium collar moulds proved to cause difficulties in grinding plants, transport plants, etc. In order to avoid such problems some works tried utilization of collar moulds made of cardboard. One object, obviously, was that the collar mould should burn in the furnace. Gradually, arguments were also heard against such a kind of collar moulds, because it may in certain cases burn down from below and thus loose its hold in the collar composition proper, so that the remaining portion of the collar mould is pulled up into the ventilation plant and may block the latter.

According to the invention a compression mould consisting of two sections is provided about the anode nipple(s), collar composition is, if desired in a pretreated state, introduced into the mould and moulded under pressure, if desired by the aid of vibration and/or heat as well, and the mould sections are removed when the moulded collar composition is completely moulded. The collar composition may, e.g. be preheated by hot air and/or a binder may be added during introduction of the composition into the mould. The collar composition will, thus, achieve a consistency permitting ready finishing to a desired shape. If there are at least two nipples placed side-by-side to be provided with collars, the collars for respective anode nipples are moulded in the form of an integrated common collar for the nipples, the compression mould sections together forming an integrated mould surrounding all nipples. The device for carrying out the above method comprises a compression mould consisting of two sections which are adapted to be brought together to surround the anode nipple(s), and which compression mould sections are adapted to be separated upon completed moulding of the collar composition which is introduced into the mould. Each mould section can be provided with a vibrator and/or at least a heating element. Each mould section may comprise a top sheet half, which is adapted to be provided on top of and to exert pressure to the top of the collar composition in cooperation with the respective lower mould section, and in other respects shows the same properties as the mould sections.

The indicated concept, however, in some cases may require much equipment to be placed in a limited area about the nipples, and it may in some cases be highly complex, both in production and in use.

An alternative concept to the above disclosed method according to the invention is provided to improve said condition by departing from the principle of direct moulding on the nipples. Instead, collar halves are preformed and may then be mounted on the nipple. According to the invention, pretreated collar composition is supplied to two collar halves, each of which correspond to a collar half, and is preformed. Both preformed collar halves are then introduced into a compression mould consisting of two mould sections, compression mould sections are positioned about the nipple, and the composition is subjected to pressure, and/or heat, and/or vibration, via the compression mould, to join the composition into one integral collar of the desired shape. Then the mould sections are separated.

Said pretreatment of the collar composition may, if necessary, suitably be achieved by hot air which is supplied to the composition while it is poured into said mould halves.

A device for carrying out such a method may comprise a mould consisting of two halves which are configurated to permit joining and separating the mould halves, and means for supplying pressure and, if desired, heat and/or vibration to the collar composition, as well as means to transfer preformed collar composition from the mould to a compression mould.

The collar composition may be supplied from a bunker and pretreated in a hot air flow to be made fictile at a correct softening point by pressure, if desired, heat and/or vibration in the mould. Upon such preheating with subsequent treatment the collar composition will have correct quantity, quality, and shape to provide good protection of the nipple when the composition is mounted about the latter, either by the first mentioned or the last mentioned method. Alternatively or supplementary to said hot air flow a binder may, if desired, be added to the composition.

If the collar composition comprises pitch or the like acting as a binder, a hot nipple may contribute to increased contact between collar, nipple, and anode. In the last mentioned method free standing moulds are used, as mentioned, which upon preforming will provide the collar composition with the desired consistency and a shape approximately corresponding to half a collar. Upon preforming the moulds are pulled apart so that both halves may be conveyed from the moulding site to the mounting site, there to be subjected to the final treatment.

As mentioned above, the anode butt is attached to the anode nipple(s) by introducing a fixing matter in the form of cast steel into the space between the anode carbon and the end portion of the nipple. During anode reconditioning after completed usage, residues from the bath and the collar, as well as said cast steel are removed. In recirculation various substances which are alien and harmful to the bath may be admixed.

For quite some time it was, thus, desired to achieve fastening between the nipple end portion and the anode butt by the aid of a material having approximately the same properties as the molten bath or the anode carbon.

According to a further method for providing collars about anode nipples it is proposed to form a hole/holes in the anode carbon for receiving at least one nipple end portion, to provide a compression mould consisting of two sections about the anode nipple(s), to supply collar composition under pressure to fill both a compression mould consisting of two sections and to be provided about the anode nipple(s), and the interspace between the nipple end portion and the anode butt, moulding and filling being carried out under pressure, if desired also including heat and/or vibration and to remove the mould sections upon completed moulding of the composition.

According to this method the nipple is fastened on the anode butt at the same time as the collar is formed. Much time is, thus, saved and disadvantageous mixture of several different matters is reduced at the same time.

Further characterizing features of the methods and devices according to the invention will appear from the following claims as well as from the following description with reference to the attached drawing.

On the basis of what was mentioned above in connection with known technology, it will be understood that the collar mould proper has no protective effect, the collar composition alone having this function. According to the present invention we renounce a collar mould to sit on the anode as an accompanying formwork after the collar composition has received its final shape.

In stead, the collar is, thus, compressed in a mould about the nipple(s) consisting of two mould halves each of which approximately corresponds to half a collar. The collar composition is moulded so as to be correctly distributed in the mould and is compressed under pressure, if desired, with heat being supplied from the sides and/or the top. The shape of the finished collar may be adapted to specifications from each user.

In this manner it is possible to prevent a collar mould of aluminium or cardboard from reaching the electrolytic cell, which not only represents economical saving, but also will prevent any pollution of the environment.

The invention provides for improved control of degassing during the process of collar mounting, so that volatile matter can be removed from the work rooms. It is a special advantage in this connection that the collar composition is preheated, e.g. by the aid of hot air or a binder. Additionally, a stronger, more homogeneous collar of a correct shape is provided, permitting the collar size to be reduced, which will result in less consumption of expensive collar composition and, thus, further saving. Obviously, a collar composition which does not contain volatile matter representing an environmental hazard may also be considered.

Figure 1:
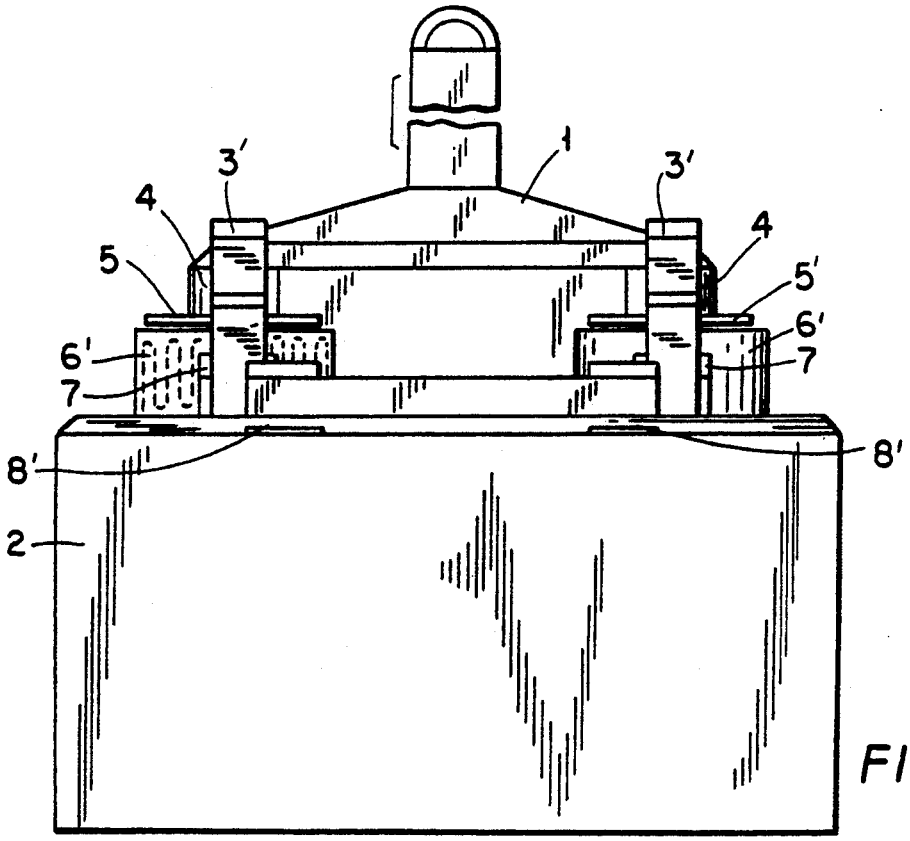
FIG. 1 is a vertical section, as seen from a longitudinal side of an anode, showing a device according to the invention and intended for use of an anode comprising two nipples.
Figure 2:
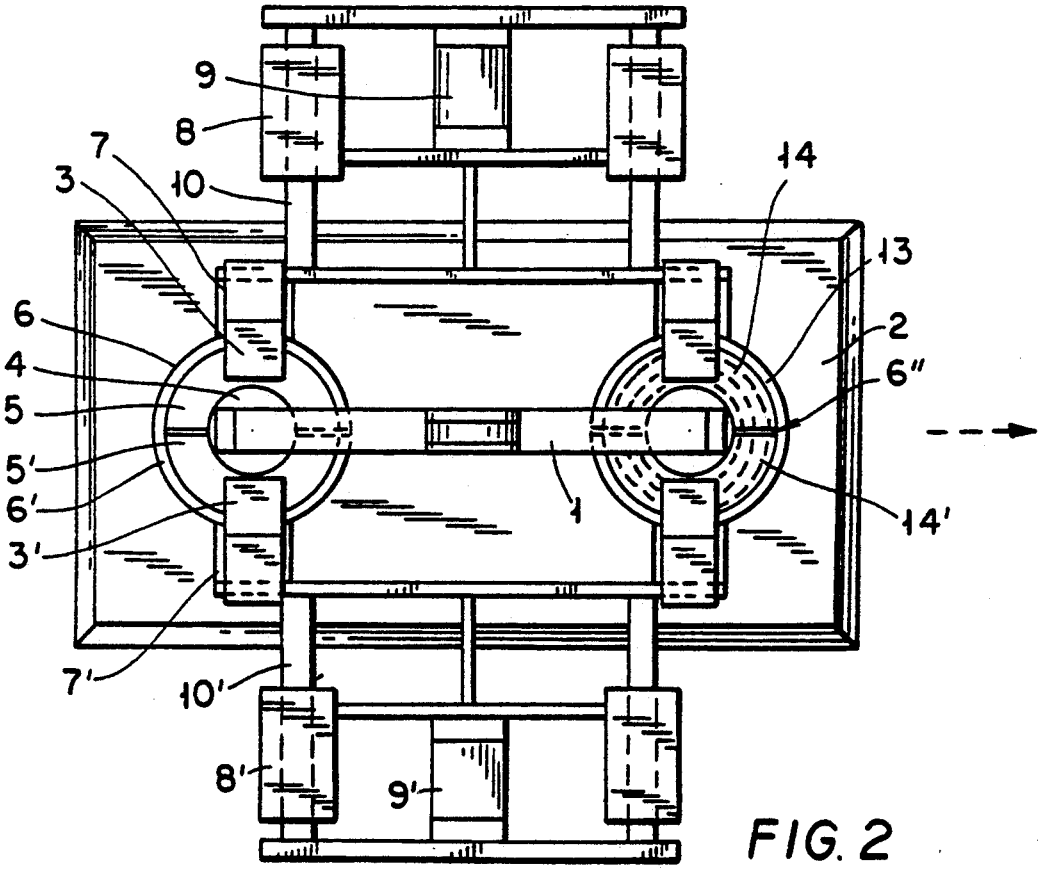
FIG. 2 is a top view of the embodiment of FIG. 1.
Figure 3:
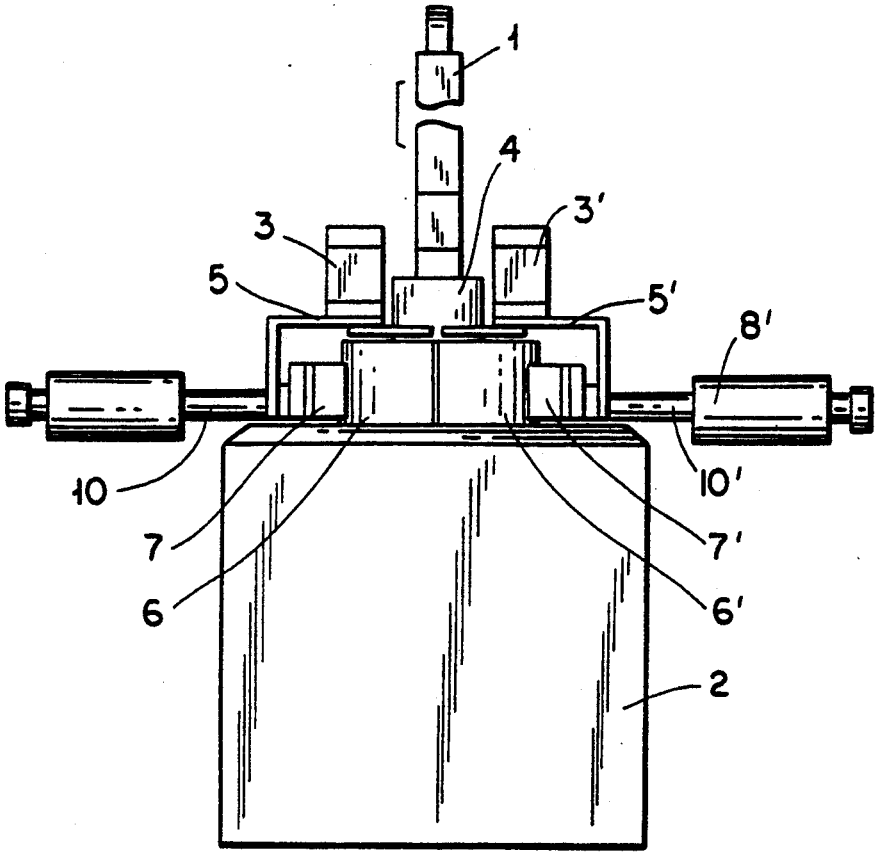
FIG. 3 shows a vertical end view of the device of FIGS. 1 and 2.

As mentioned, FIGS. 1–3 show an example of the invention used for an anode 2 which has two nipples 4, as well as the the principle of the mechanical equipment needed to carry out the method.

The compression mould for the collar composition may comprise two compression mould halves 6, 6'. They may, if desired, contain respective heating elements (not shown), and they are suspended or provided with a vibrator 7,7', respectively, which may be connected with a support 8, 8', via a shaft 10,10' e.g. made of steel. The compression mould halves may be displaced forwards and backwards by the aid of two jacks, e.g. hydraulic or pneumatic cylinders 9,9'. In order to provide free passage for anode 2 and its hanger means 1, the equipment must be distributed on both sides of the conveying system which is used for the anode, and 90° to the direction of anode movement, as indicated by an arrow in FIG. 2.

Starting the moulding process, the two mould halves, noted 6 and 6', respectively, in FIG. 2, are conveyed to a position where they join to form a complete casing. At the transition between the mould halves a compressible zone, the position of which is indicated by numeral 6'', is formed which permits compression of the halves during the compression process (and, if desired, the heating process).

The composition may, if desired, be vibrated by the aid of said vibrator 7 to be homogeneously distributed in the mould halves. On the mould comprised of two halves 6,6', top plate halves 5,5' (FIG. 2) are provided and may also comprise heating elements. Preferably, halves 5,5' are also provided with said compressible zone, and they are positioned and lowered towards the collar composition at the same time as the mould halves are compressed. If heating elements are used, they will all, i.e. both those in the mould halves 6,6' and in the top plate halves 5,5', be activated during this operation. Due to the fact that the composition may be slightly inhomogeneous, compression ought to be time controlled in a preprogrammed manner.

Jacks, as indicated by numerals 3 and 3', are used to urge top plate halves 5,5' down towards the collar composition. After completion of the compression process, if desired, with baking, all mould members 5,5' and 6,6' are retracted, so that the anode can be conveyed as indicated by the arrow in FIG. 2. The equipment will then be ready for treatment of the next anode.

Figure 4:
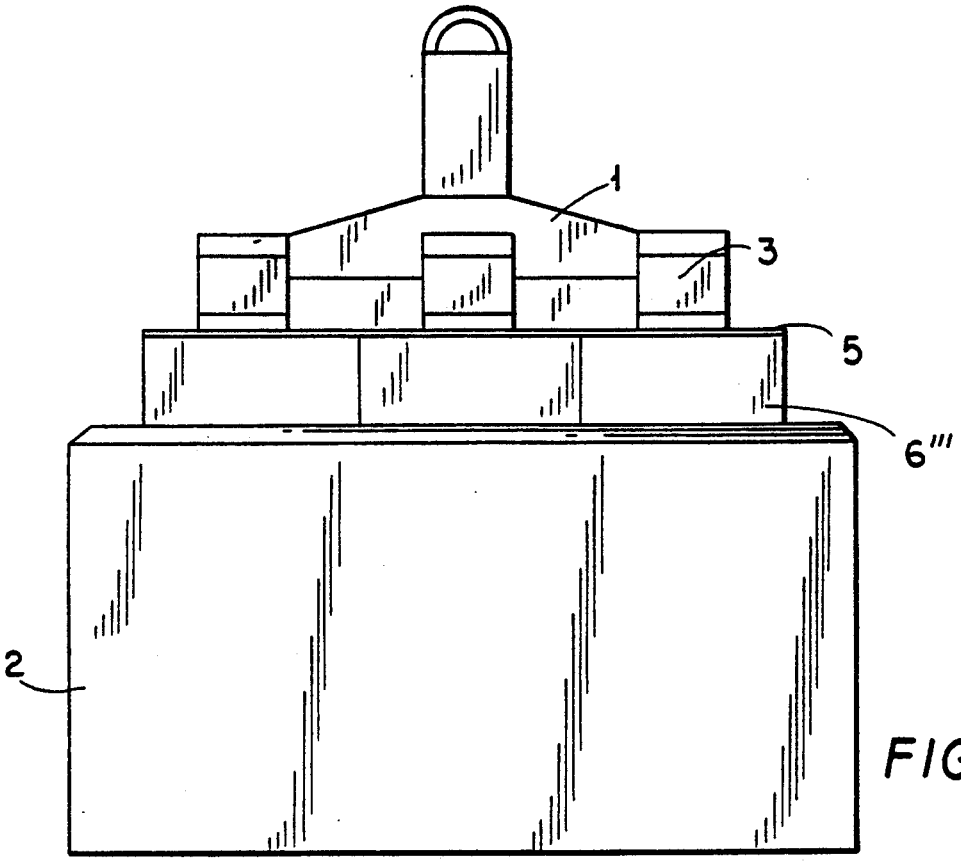
FIG. 4 is a vertical view, as seen from a longitudinal side of the anode, and showing a device according to the invention, used on an anode totally comprising 6 nipples, with three nipples arranged in each of two rows.
Figure 5:
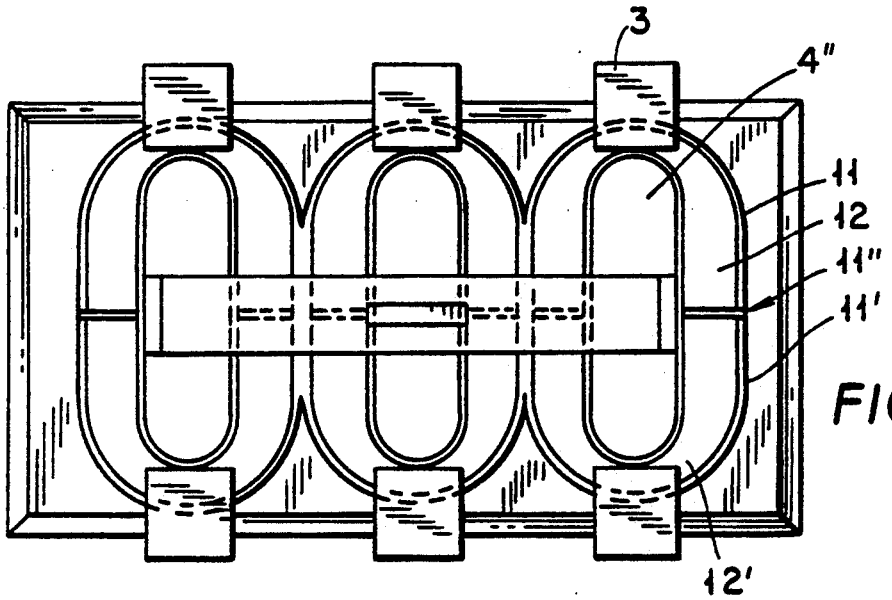
FIG. 5 is a top view of the device shown in FIG. 4.

In FIGS. 4 and 5 a modification of the embodiment of FIGS. 1–3 is shown in a slightly simplified form. It will be understood that members 7, 8, 9, 10, 13, and 14, as well as 7', 8', 9', 10' 13', and 14 will also be present in this embodiment.

We indicate here how the present invention may be used for an anode with six nipples, generally noted by numeral 4', and where sets of three nipples each are provided in two respective longitudinal rows. In most cases the nipples will be so closely arranged that the collar composition can be moulded in one piece about all nipples. The same normally also goes for anodes with 4 nipples which are arranged in two rows. In FIGS. 4 and 5 two compression mould halves 11 and 11' are shown. As shown in FIG. 5, they cover a whole longitudinal side in one piece as well as half a short side of the anode. In the joining area they also have compressible zones, generally noted by numeral 11''. Furthermore, there are top plates 12, 12' having the same functions and properties as disclosed in connection with top plate members 5,5' in FIGS. 1–3.

In most cases the nipples will be so close to each other that the collar composition can be formed into one piece about all nipples. This will also be true for anodes having four nipples arranged in two rows. If the distance between nipples shown in the direction of the arrow is larger than indicated in FIG. 5, it will, however, be suitable to form collar composition in one piece about two nipples across rows at a time. In FIG. 2 the distance between nipples, however, is so large that it is not practical to mould a collar about both nipples in one piece. For the rest, the operations with the embodiment of FIGS. 4 and 5 are completely identical with the disclosure in connection with FIGS. 1–3.

Even though the above disclosed application of the invention is primarily described in connection with embodiments comprising two, and six nipples, respectively, the invention may, obviously, be equally applicable to anodes having a different number of nipples from that shown and disclosed.

Figure 6:
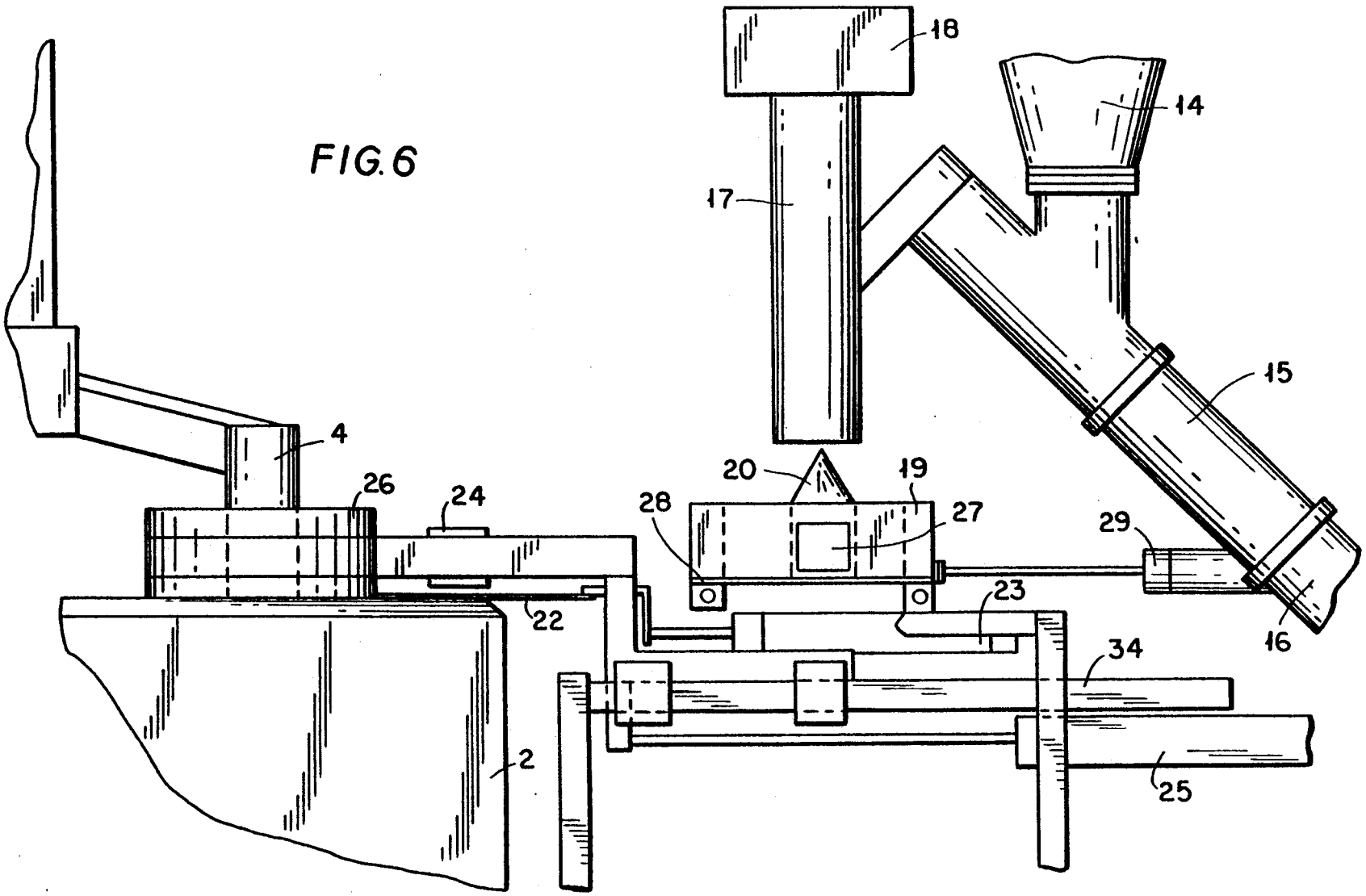
FIGS. 6 and 7 illustrate a modification of the embodiment of FIGS. 1–3, as seen in elevation, and top view, resp.
Figure 7:
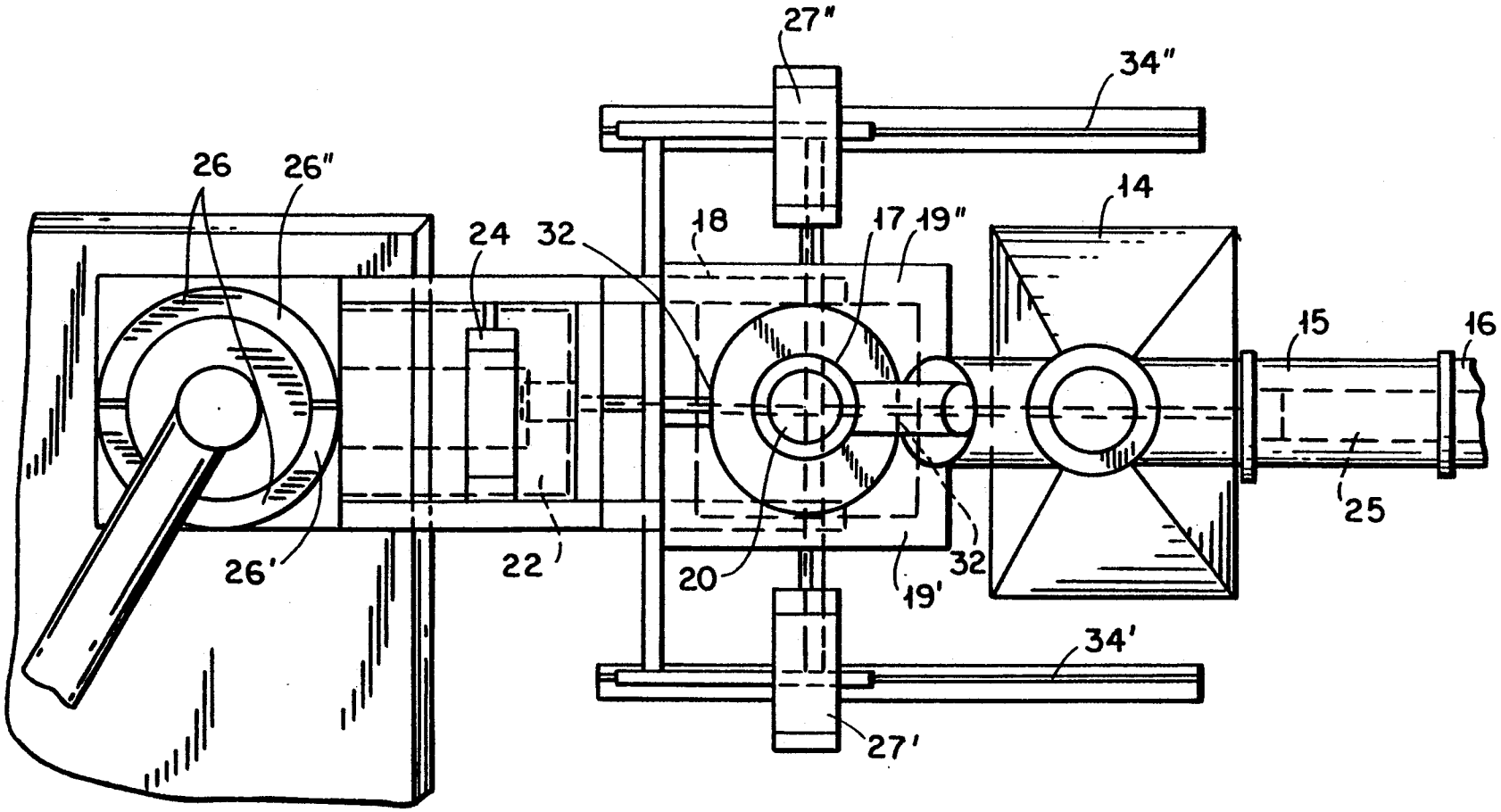

In connection with preforming of collar halves reference is now made to FIGS. 6 and 7. Collar composition is supplied to moulds from a bunker 14, cf. FIG. 6, through a depositor system 15, 16 comprising a filler unit 15 which has a chamber with one movable end wall in the form of a piston which is driven by a compressed air cylinder 16. By adjusting the length of cylinder stroke the filling unit will supply a certain volume of collar composition, adapted to the actual collar size. The collar composition is conveyed from filling unit 15, through a pipe 17 where the composition is heated to a suitable softening point by air from a hot air heater means 18 which is mounted on pipe 17. The lower portion of pipe 17 may have a shape which is adapted to the curvature of the collar mould half, if desired, it may comprise a movable lowermost portion to permit collar composition to be introduced into the mould in a correct manner. Alternatively, or supplementary to hot air heater means 18 a means supplying a suitable binder to the collar composition may be considered. In the shown embodiment it is proposed to pour collar composition towards the top of core 20 of the mould 19. The core is cone-shaped to serve as a "false" nipple and will, thus, contribute to correct distribution of the collar composition in the mould.

Mould 19 is comprised of two mould halves 19', 19'', and it is shaped so as to permit jacks 27,27' to cause the composition to be shaped into two collar halves.

To make composition falling down into the mould 19 stay inside a member 28 is positioned beneath mould 19 to form its bottom. In order to achieve a correct volume of the filling it is also necessary to pull mould halves 19',19'' slightly apart. The mould will, thus, not be tight at one side. Tightening of the mentioned lateral openings may, e.g. be achieved by use of thin spring steel, designated by numeral 32 in FIGS. 7 and 12, which is mounted inside one mould half on both sides and sits across the openings, and abuts against the inside of the other mould half. Such spring steel members will adapt to the inside of the mould during compression, and will return to their original shape upon completion of the process.

Figure 8:
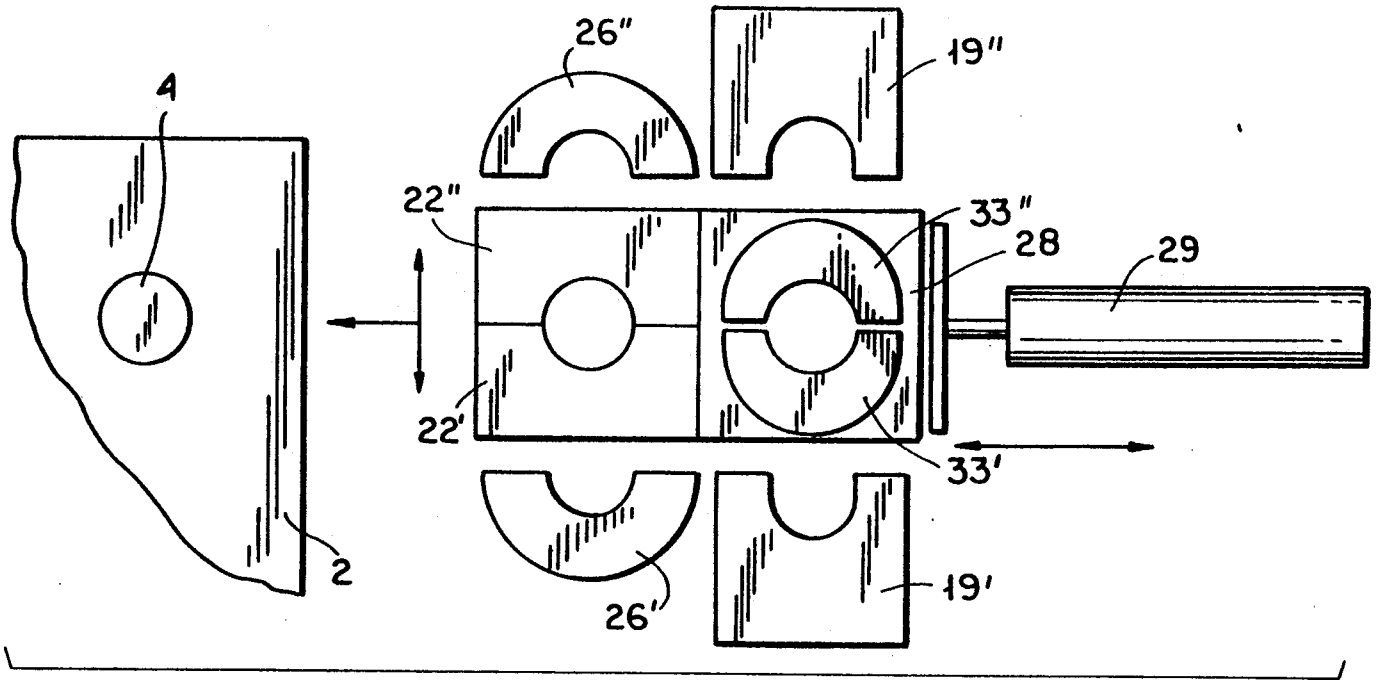
FIG. 8 shows a simplified view of the device according to FIGS. 6 and 7.

Upon compression in the mould, the mould halves are pulled so much apart, see FIG. 8, that the prefabricated collar halves 33', 33'' can be treated freely and transferred from the bottom surface 28 of the mould to the lower plates 22' 22'' by the aid of a jack 29. The mould halves 19', 19'' are pulled laterally by the aid of jacks 27', and 27'', respectively, see FIG. 7.

As will appear from FIGS. 6 and 7, sliderails 34 are provided, designated 34', and 34'', resp., by the aid of which said lower plate may be caused to slide in a controlled manner towards said member 28 for transfer of collar composition.

After the process of preforming the collar halves have a shape and consistency suitable for further treatment, i.e. a shape ensuring correct filling of the compression moulds 26 (26',26'') during mounting, so that waste of collar composition is avoided and optimal compression and contact between nipple, anode, and collar is achieved.

An automatic handling machine functions to convey collar halves and said compression mould halves 26', 26'' forward to each side of nipple 4. Positioning is determined by the nipple proper, so that any deviations of the anode will have no effect on mounting operations.

The lower plate members 22',22'' on which collar halves 33', 33'' sit will be retracted by jack 23, so that the collar halves fall down onto the anode. Compression mould sections 26', 26'' are then compressed by jack 24 until the final collar shape is achieved and the collar has optimum density. Then mould sections 26',26" are pulled apart by the aid of jack 24, and are retracted by jack 25, which causes movement forwards and backwards, and new preformed collar halves which were produced while the former were mounted, are now fetched.

Figure 9:
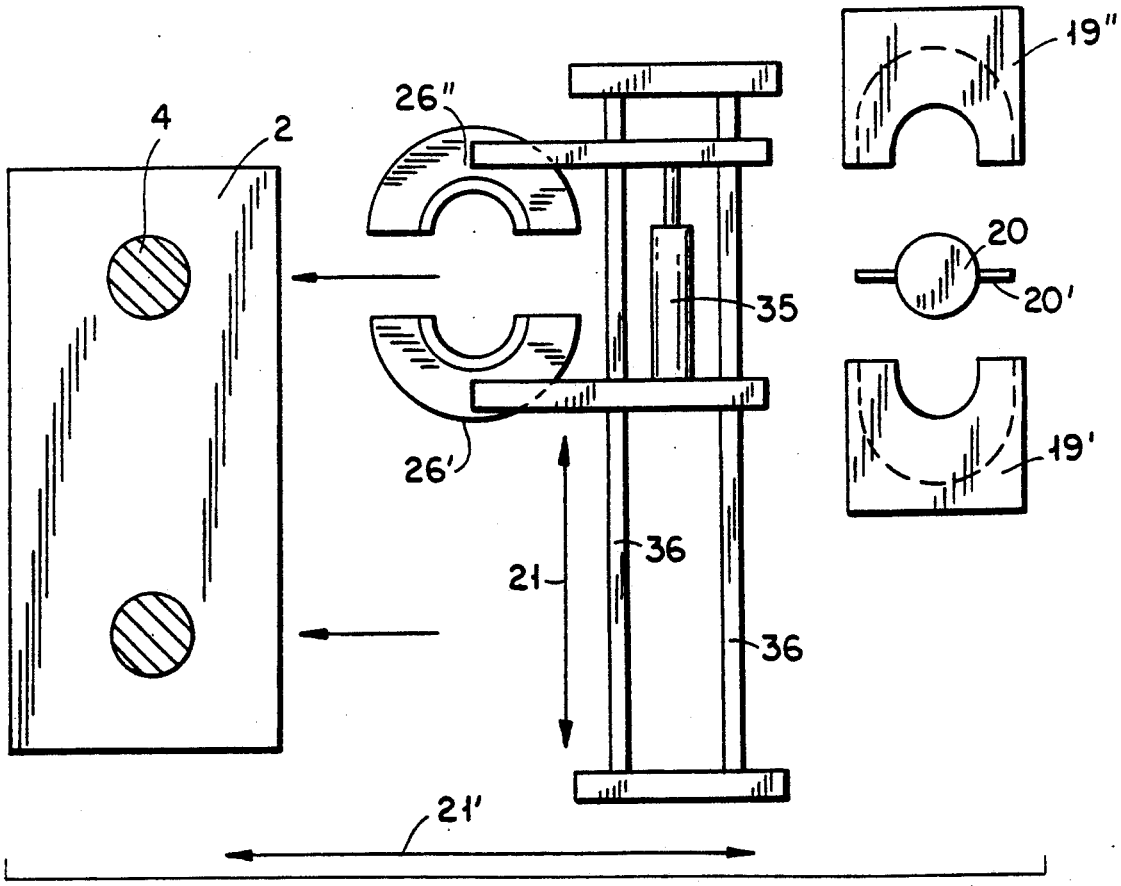
FIG. 9 illustrates an alternative embodiment to the concept shown in FIGS. 6–8.

In FIG. 9 it is shown how the false nipple 20 may be shaped. It may comprise a cone with wings 20' to permit separation of the mould halves in the centre. Furthermore, it is shown in FIG. 9 how compression mould halves 26',26" may be separated and moved in the direction of arrows 21 and 21'. It will, thus, be relatively simple to provide collars, e.g. on two nipples, by displacement of compression mould sections both in the direction of arrow 21, and arrow 21'. A jack means 25 is adapted to change the mutual distance between compression mould halves 26' and 26". It will be obvious that double arrow 21 symbolically indicates a device for moving the compression mould sections in an assembled state along guides 36. Numeral 21 also symbolically indicates movement of the entire unit designated by 21, 26', 26", 35, 36 to the right or to the left along arrow 21'.

For simplicity, FIG. 9 does not show the mentioned shutter means, and lower plates, as shown in FIG. 8. Such members, however, must obviously be present, as well as moving elements to move the composition from the preforming station to the compression mould station.

As shown in FIG. 9, it will be understood that the mould is firmly positioned, whereas the compression mould is displaceable.

Figure 10:
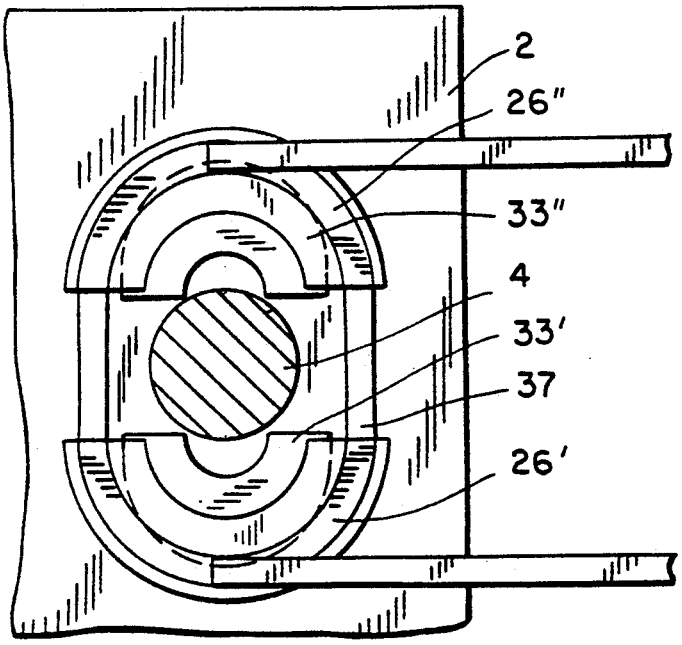
FIG. 10 illustrates the collar composition immediately prior to its compression in place by the compression moulds.

It is illustrated in FIG. 10 how collar composition 33',33" sits on anode butt 2 and is ready to be compressed about nipples 4. In FIG. 2 bottom plates 22', 22" are not shown for reasons of simplicity. It will appear that the preformed collar composition is shaped so as to be too narrow to fill compression mould halves, and that most of the composition sits rearmost in the moulds. When compressed the composition will be forced outwards to the sides to fill the void, as compression mould sections 26',26" are then joined, and there will be no leakage at the joint between mould sections.

Compression of the mould sections preferably may be carried out with relatively high speed.

In order to ensure smooth joining of mould halves they may, if desired, be provided with packing means 37, suitably of a resilient kind.

Figure 11:
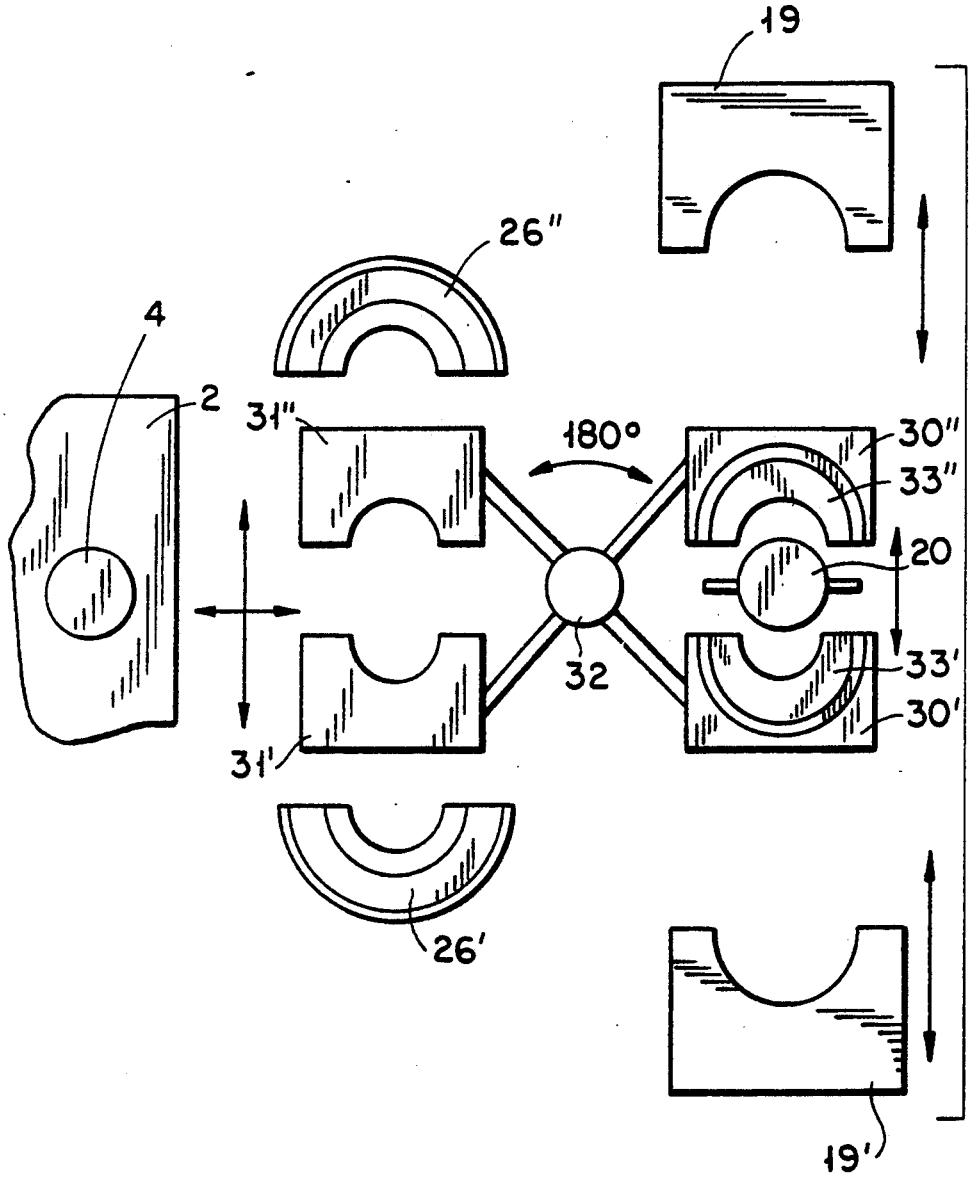
FIG. 11 is an alternative embodiment to the embodiment shown in FIG. 8.

FIG. 11 illustrates an alternative transfer of preformed collar composition 33', 33" from casting mould 19 to compression mould 26. At the same time as mould 19 is retracted false nipple 20 with the partition is pulled down and out of the work area. The composition will then sit freely on bottom plate 30 of the mould. At this stage the composition may be conveyed, e.g. by use of two sets of bottom plates 30', 30", and 31', 31", forming the bottom of casting mould and compression mould, respectively, however being exchangeable, said plates being rotatable ±180° on a carrousel 32, so that one set serves as a bottom in the mould, and the other set 31 serves as a bottom in the compression mould in one instance, whereas they function vice versa the next.

For this method it is required that the compression mould and the forming mould may be retracted far from each other to leave enough space for the rotational movement.

This method as well as the method disclosed above are based on the fact that the preformed collar halves must be separated to the extent necessary to insert them on each side of the nipple.

Furthermore, the compression mould will be moved inwards on both sides of the nipple at the same time as the collar halves. Bottom plate 22 is retracted, so that the collar halves fall down onto the top of the anode, at the same time as they are correctly placed inside the compression mould. The compression mould should provide necessary counterhold to permit retraction of the bottom without the collar halves following. It may also be necessary to provide collar halves with a shape which will simplify counterhold in the compression mould and contribute to position the mould halves correctly about the nipple.

It will be understood from the above mentioned that it is important that the collar halves have a shape permitting the compression moulds to be compressed without collar composition leaking out through the openings between mould halves. By premoulding the collar halves will achieve such a shape.

The concept disclosed in connection with FIG. 11 is considered the most simple and safe approach to transfer composition from the casting mould to the compression mould. Shaping a collar about only one nipple at a time is considered the best embodiment. It will probably be possible to model compression moulds and casting moulds in such a manner that the desired homogeneity is achieved. In fact, it is the time available for mounting all nipples which will decide whether it is possible to mount one collar at a time. If high speed is requisite it will be correct to use several units operating independently.

It will be understood that, time permitting, it will be possible to mount collars and nipples in two rows by the aid of one unit and from one side. This may be achieved by moving collar halves and compression mould past the closest nipple on to the second row of nipples. The only change that may be required to achieve this, is that the conveying mechanism is provided with a longer path of movement.

The compression mould with bottom must be displaceable along the anode in suitable steps to permit mounting collars on all nipples in one row without moving the anode.

Figure 12:
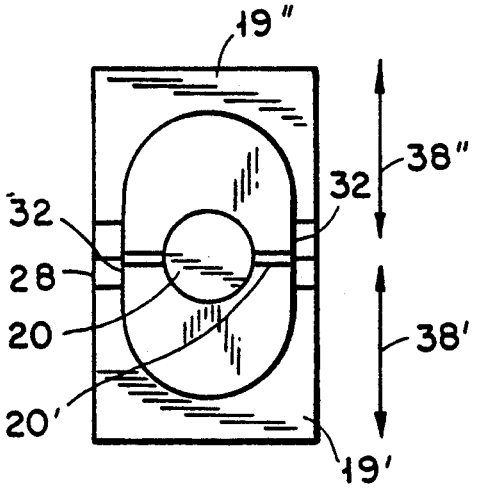
FIG. 12 illustrates the principle of the moulds forming preformed collar composition.

In FIG. 12 casting mould halves 19',19" are shown. As indicated by arrows 38', 38", mould halves 19', 19" are movable forwards and backwards, preferably the aid of pneumatic jacks. As mentioned above, spring steel seal is designated by numeral 32.

Figure 13:
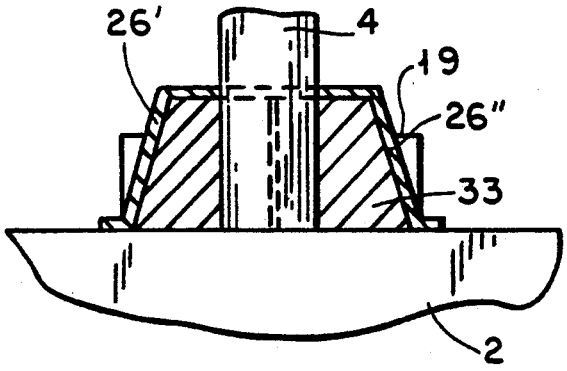
FIG. 13 is a cross sectional view of a compression mould surrounding a nipple.

FIG. 13 illustrates a compression mould in a sectional view. The compression mould has the final collar shape, i.e. the shape desired by each separate user.

It will be understood from FIG. 11 that the bottom plate halves 30',30" are slightly displaced from each other, and so are plate halves 31',31", due to the structure of carrousel 32, as said mutual distance between plates 30,'30" must be large enough to permit the plates to be inserted on respective sides of nipple 4. Compression mould halves 26 must be joined about collar halves on plate 31 before they are conveyed to nipple 4.

Figure 14:
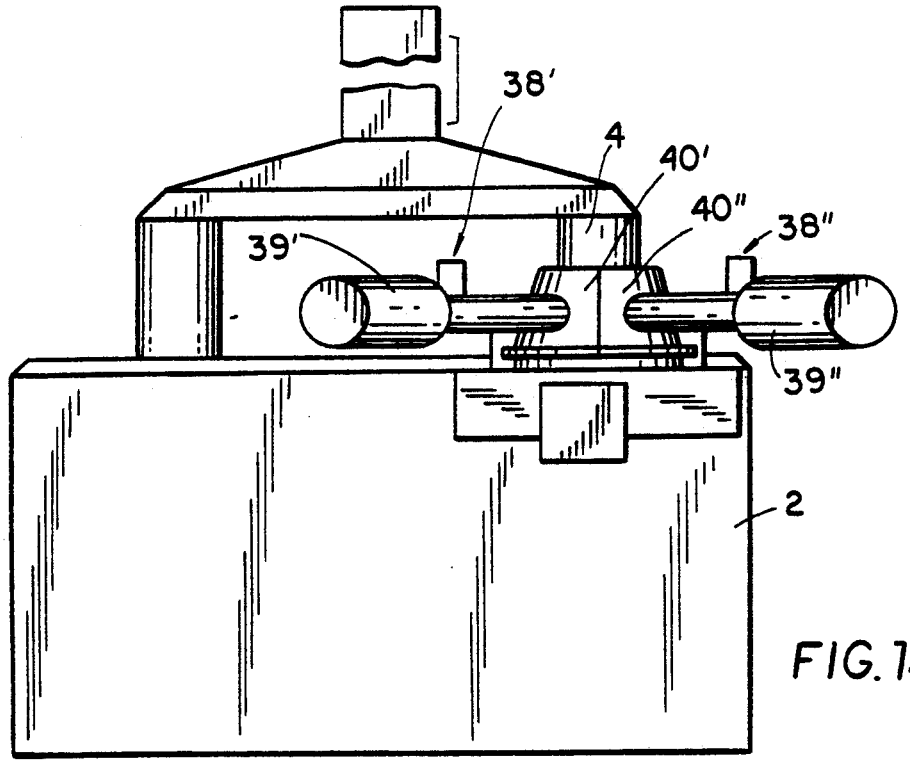
FIG. 14 shows a modification of the device according to FIGS. 1–3, where the collar composition is introduced into the compression mould by injection.
Figure 15:
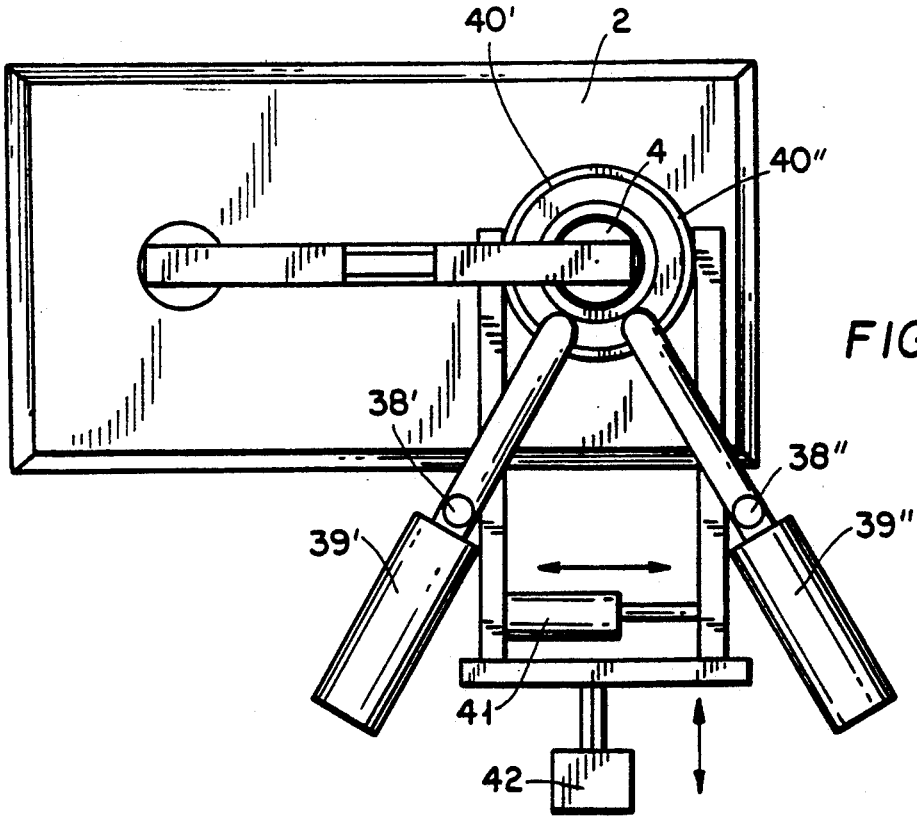

In FIGS. 14 and 15 an elevation and a top view, respectively, of a modified embodiment of what is shown in FIGS. 1–3 are illustrated. Collar composition of a suitable consistency is supplied through openings 38',38' in injection devices 39', 39". Injection into compression mould sections 40',40" may occur in one or several places in each section, although for simplicity, only one point of injection is shown in each section in FIG. 15. Obviously, injection may also occur from a diametral point in FIG. 15.

Injection means 39',39" may be of the cylinder/piston kind, with the piston stroke ends aligned with the inside of compression mould 40. This means that the piston (not shown) must have a top surface of the same shape as the inner face of the compression mould where the piston arrives.

Compression mould sections 40',40" can be moved towards and away from each other by the aid of a jack 41. Furthermore, elements 38–41, see FIG. 15, can be moved to and from nipple 4 by the aid of a moving apparatus 42. The advantage of the concept shown in FIGS. 14 and 15 is that supply of composition occurs in a very simple and controlled manner, and in this concept it is not necessary to preform the collar.

Figure 16:
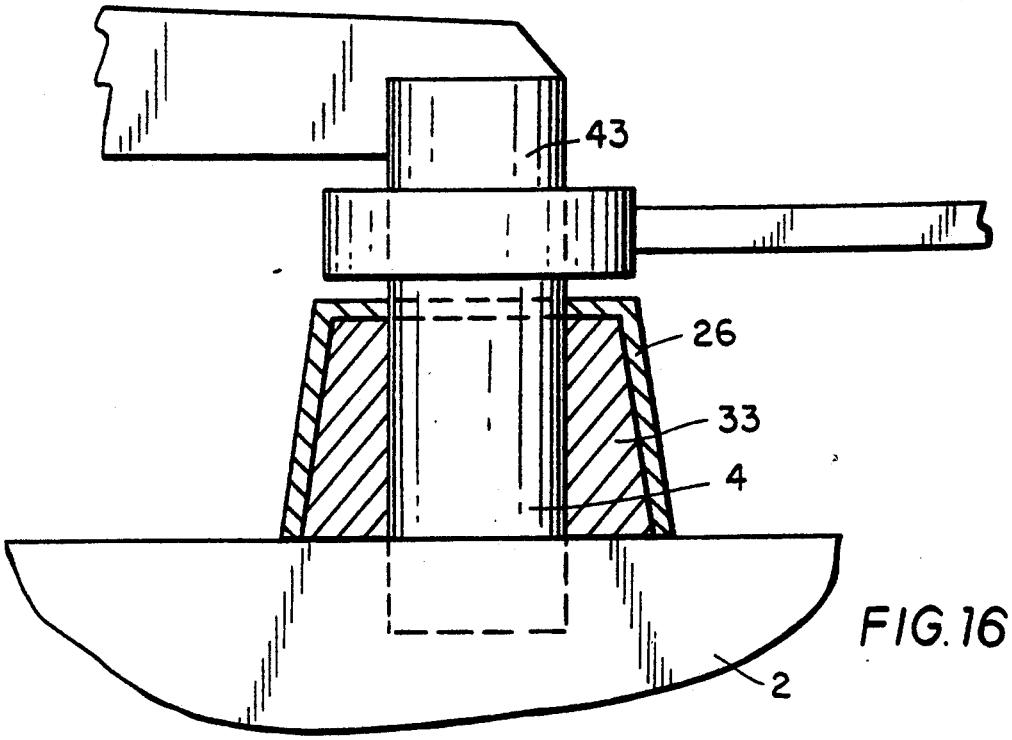
FIG. 16 illustrates induction heating of an anode nipple in connection with a compression moulded anode collar.

In FIG. 16 it is shown how a collar 33 is formed about a nipple 4 by the aid of a compression mould 26. Nipple 4 is attached to anode carbon 2 in a conventional manner, as mentioned above.

In order to ensure better adherence between composition 33 and nipple 4 it is suggested to use an induction heater 43. Adherence to the nipple may then be considerably improved by use of a suitable material for the collar composition, at the same time as the collar composition is optimally cured. This may e.g. be achieved by maintaining heat development generated by induction in the anode nipple until collar composition 33 has reached a certain surface temperature.

Figure 17:
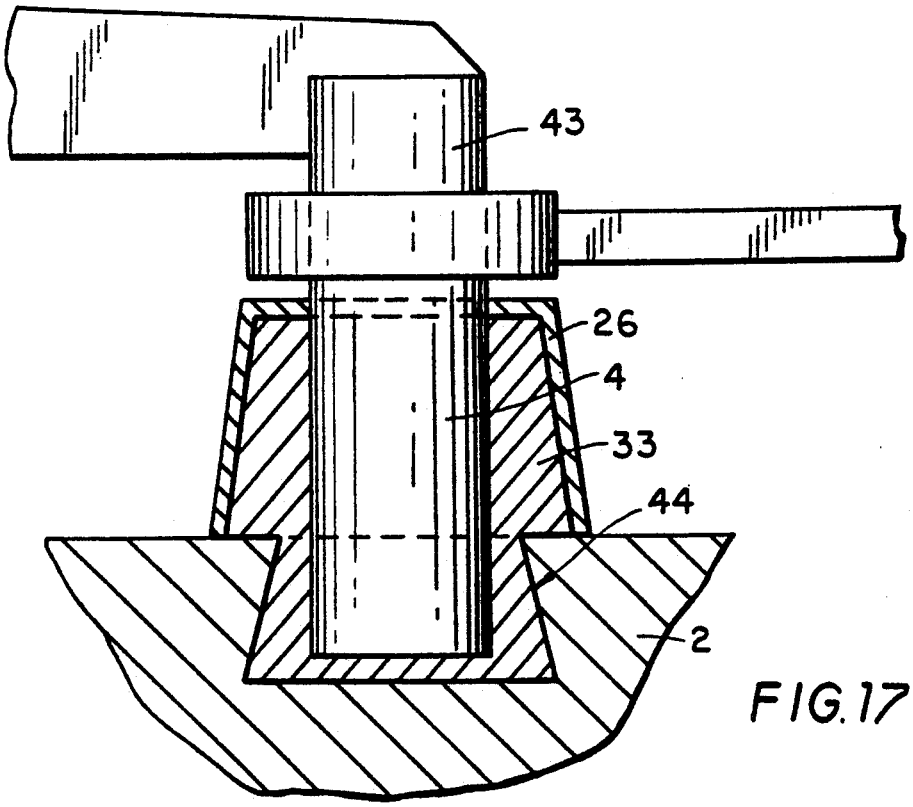
FIG. 17 shows a unitary making of a nipple collar and nipple/ anode butt attachment with possible induction heating of the anode nipple.

The matter disclosed above in connection with FIG. 16, is slightly expanded in FIG. 17. As mentioned above, it is disadvantageous to provide a mixture of many kinds of materials which in the worst case might end up in the molten bath. It has especially been desirable to avoid cast steel attaching the nipple 4 to anode butt 2. In the embodiment shown in FIG. 17 a hole 44 in the anode butt is provided with a counterhold, e.g. by receiving a shape substantially like a dovetail in cross section (conical) with the narrow portion uppermost. According to the invention it is suggested to introduce collar composition into compression mould 26 in such a manner that the composition will also penetrate into the interspace between nipple 4 and anode butt 2. The composition is squeezed outwards under pressure, if desired with slight vibration and/or heat supply. Heat supply may be achieved as disclosed in connection with FIGS. 1–3, alternatively or supplementary by inductive heating from an inductive heat generator 43. With suitable compositions good adherence may, thus, be ensured between the composition and nipple, at the same time as any curing of the composition may be achieved by the aid of heat from anode nipple 4 proper. As mentioned in connection with FIG. 16, heat may be supplied by the aid of inductive coupling 43, until the surface temperature of collar 33 has reached a specific temperature, which ensures substantially complete curing of composition 33.

In this manner a very advantageous operation is achieved, and the number of substances involved is considerably reduced at the same time.

In the disclosure above general reference was made to collar composition. Such collar composition may be of any suitable kind, e.g. heated composition, glue-based composition, a composition with binder, heat curable composition, or compression formed composition. In connection with a heat curable composition it will, obviously, be advantageous to use an induction heated nipple 4.

By the aid of the present invention methods and devices are, thus, provided which are economical at the same time as the problem with a collar sheet of aluminium in connection with the purification process is avoided. Alternatively, the problem of collar moulds made of cardboard which clog ventilation plants is also avoided. In case the composition contains additives which are harmful to the environment, degassing will occur in a controlled manner. If desired, the invention permits use of collar compositions containing additives which are not harmful to the environment. Finally, the present invention provides a method which is at least as quick or quicker than the previously known methods, at the same time as the produced collar will show improved strength, a more correct shape and will thus, provide improved protection of the anode nipple, and a longer life of the anode.

I claim:

1. A method to provide collars about an anode nipple or nipples, characterized in that a compression mould comprising two sections is arranged about the anode nipple or nipples, that pretreated collar composition is supplied to the compression mould and is moulded under pressure, and that the mould sections are removed when the collar composition is completely moulded.

2. A method as stated in claim 1, where at least two anode nipples placed side-by-side are to be provided with collars, characterized in that the collars for the respective anode nipples are formed in the shape of one integrated collar for the nipples, the mould sections together forming an unbroken mould would surrounds all nipples.

3. A method as stated in claim 1, characterized in that collar composition is supplied to each compression mould section through at least one feeding nozzle.

4. A method as stated in claim 3, characterized in that the nozzle is of a cylinder/piston kind, and that a piston stroke is caused to end flush with the inner surface of the compression mould.

5. A method as stated in claim 1, characterized in that the compression mould has a shape causing the collars to receive the shape of a truncated cone.

6. A method as stated in claim 1, wherein the collar composition is either heated, glue based, binder based, heat curable, or compression mouldable.

7. A method as stated in claim 1, wherein the pretreated collar composition which is molded under pressure is heated or vibrated or both.

8. A method as stated in claim 7, characterized in that said compositions which are joined are caused to change their consistency by heating.

9. A method as stated in claim 7, characterized in that the collar composition is pretreated by the aid of hot air which is supplied to the composition when the latter is fed to the mould.

10. A method as stated in claim 7, characterized in that heat is supplied to said composition by induction heating of said nipples.

11. A method to place collars about anode nipples, characterized in that pretreated collar composition is supplied to casting mould halves, each of which corresponds to a collar half, and is preformed there, that both preformed collar halves are then introduced into a compression mould comprising two mould halves, that the compression mould halves are positioned about the nipple, upon which pressure is exerted on the composition, via the compression mould, so that it is joined and formed to one integrated piece with the desired collar shape, the compression mould sections then being separated.

12. A method as stated in claim 11, characterized in that transfer from casting mould halves to compression mould halves is achieved by the aid of transfer plates.

13. A method as stated in claim 12, characterized in that the transfer plates are arranged in a carrousel means.

14. A method as stated in claim 12, characterized in that the transfer plates are movable in straight lines.

15. A method as stated in claim 11, wherein the composition to which the pressure is exerted via the compression mould is heated or vibrated or both.

16. A method as stated in claim 11, wherein the compression mould has a shape causing the collars to receive the shape of a truncated cone.

17. A method as stated in claim 11, wherein the collar composition is either heated, glue based, binder based, heat curable, or compression mouldable.

18. A method to provide collars about anode nipples, characterized in that a hole is formed in an anode butt to receive a nipple end portion, that a compression mould comprising two sections is arranged about the anode nipples, that collar composition is actuated under pressure to be supplied to and fill both the compression mould for a nipple collar and the interspace between the nipple end portion and the anode butt so that the collar composition may be moulded, and that the mould sections are removed when the collar composition is completely moulded.

19. A method as stated in claim 18 wherein each of said hole means in said anode butt is formed in the form of a truncated cone with a dovetailed vertical cross-section.

20. A method as stated in claim 18, wherein the compression mould has a shape causing the collars to receive the shape of a truncated cone.

21. A method as stated in claim 18, wherein the collar composition is either heated, glue based, binder based, heat curable, or compression mouldable.

22. A device for providing a collar about an anode nipple or nipples, comprising a compression mould having two sections which are arranged to be guided towards each other to surround the anode nipple or nipples, the compression mould sections being arranged so that they can be moved apart when a collar composition supplied to the mould is completely moulded.

23. A device as stated in claim 22, wherein at least one compression mould section is provided with a vibrator or heating means or both.

24. A device as stated in claim 22, wherein the compression mould sections have means for injecting collar composition into the compression mould and means for compression of the collar composition.

25. A device for providing anode nipple collars, comprising a casting mould consisting of two halves which are designed to permit joining and separation of the casting mould halves, a compression mould consisting of two sections which may be joined and separated and comprise means for supplying pressure to a collar composition and means to transfer preformed collar composition from the casting mould to the compression mould.

26. A device as stated in claim 25, wherein at least one compression mould section is provided with a vibrator or heating means or both.

27. A device as stated in claim 25, wherein the compression mould sections have means for injecting collar composition into the compression mould and means for compression of the collar composition.

28. A device as stated in claim 25 wherein the composition mould sections further comprise means for delivering heat to said collar composition.

29. A device as stated in claim 25 wherein the composition mould sections further comprise means for delivering vibration to said collar composition.

* * * * *